US010689956B2

(12) United States Patent
Agarwal et al.

(10) Patent No.: US 10,689,956 B2
(45) Date of Patent: Jun. 23, 2020

(54) RETRIEVAL OF MULTI-COMPONENT PLUNGER IN WELL PLUNGER LIFT SYSTEM

(71) Applicant: WEATHERFORD TECHNOLOGY HOLDINGS, LLC, Houston, TX (US)

(72) Inventors: Manish Agarwal, Cypress, TX (US); Cardinal T. Nforgwei, Houston, TX (US); James R. Bracken, Mineola, TX (US); Darryl Albers, Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 298 days.

(21) Appl. No.: 15/290,829

(22) Filed: Oct. 11, 2016

(65) Prior Publication Data

US 2018/0100381 A1 Apr. 12, 2018

(51) Int. Cl.

| | |
|---|---|
| ***E21B 43/12*** | (2006.01) |
| ***F04B 47/12*** | (2006.01) |
| ***E21B 33/068*** | (2006.01) |
| ***F04B 47/00*** | (2006.01) |
| ***F04B 53/14*** | (2006.01) |

(52) U.S. Cl.

CPC ..... *E21B 43/121* (2013.01); *E21B 33/068* (2013.01); *F04B 47/00* (2013.01); *F04B 47/12* (2013.01); *F04B 53/14* (2013.01)

(58) Field of Classification Search

CPC ..... E21B 33/068; E21B 43/121; F04B 47/00; F04B 47/12; F04B 53/14

See application file for complete search history.

(56) References Cited

U.S. PATENT DOCUMENTS

| | | | |
|---|---|---|---|
| 6,148,923 | A | 11/2000 | Casey |
| 6,209,637 | B1 | 4/2001 | Wells |
| 6,467,541 | B1 | 10/2002 | Wells |

(Continued)

FOREIGN PATENT DOCUMENTS

WO 2013131165 A1 9/2013

OTHER PUBLICATIONS

European Search Report dated Mar. 13, 2018 for EP Patent Application No. 17195913.3, 9 pages.

(Continued)

*Primary Examiner* — Caroline N Butcher

(74) *Attorney, Agent, or Firm* — Smith IP Services, P.C.

(57) ABSTRACT

A plunger lift method can include introducing a plunger sleeve and a plunger closure into a well, engaging the sleeve with the closure, securing the sleeve and closure to each other in a flow passage of the well, and then retrieving the sleeve and closure from the well. A plunger lift system can include a plunger sleeve configured for reciprocal displacement in a flow passage of the well, a plunger closure configured to block flow through a flow path of the sleeve and being displaceable in the flow passage separate from the sleeve. A plunger retrieval device may displace with the sleeve in the flow passage and secure the closure against displacement away from the sleeve. Another plunger retrieval device may be positioned in a lubricator, whereby the plunger retrieval device engages the closure and secures the closure against displacement away from the sleeve in the lubricator.

18 Claims, 12 Drawing Sheets

(56) References Cited

U.S. PATENT DOCUMENTS

| | | | | |
|---|---|---|---|---|
| 6,688,385 | B1 | 2/2004 | Moe | |
| 6,719,060 | B1 | 4/2004 | Wells | |
| 6,725,916 | B2 | 4/2004 | Gray et al. | |
| 6,935,427 | B1 | 8/2005 | Billingsley | |
| 7,080,692 | B1 | 7/2006 | Kegin | |
| 7,243,730 | B2 | 7/2007 | Casey | |
| 7,314,080 | B2 | 1/2008 | Giacomino | |
| 7,383,878 | B1 * | 6/2008 | Victor | E21B 43/121 166/105 |
| 7,448,442 | B2 | 11/2008 | Wells | |
| 7,451,823 | B2 | 11/2008 | Wilson | |
| 7,513,301 | B2 | 4/2009 | Victor | |
| 8,181,706 | B2 | 5/2012 | Tanton | |
| 8,485,263 | B2 | 7/2013 | Lembcke | |
| 2004/0226713 | A1 | 11/2004 | Townsend | |
| 2007/0039739 | A1 * | 2/2007 | Wilson | E21B 27/02 166/369 |
| 2016/0090827 | A1 | 3/2016 | Agarwal et al. | |
| 2016/0097265 | A1 * | 4/2016 | Bishop | E21B 43/121 166/372 |

OTHER PUBLICATIONS

Smiley, B. & Portillo, J.; "Ball and Sleeve Plunger System Automation Algorithm Utilizing Ball Fall Rates", Gas Well Deliquification Workshop, dated Feb. 17-20, 2013, 22 pages.

Allen, B. et al.; "Pacemaker Plunger Operations in Greater Natural Buttes", Gas Well Deliquification Workshop, dated Feb. 23-26, 2009, 26 pages.

Weatherford; "Plunger-Lift Systems 2008 Catalog", dated 2008, 86 pages.

Weatherford; "Auto-Catch Assembly", company brochure No. 2878.00, dated 2007, 1 page.

Shale Tec, LLC; "Which Plunger is Right for my Well?", web article via https://www.shaletec.com/faq/which-plunger-is-right-for-my-well/, dated Sep. 8, 2016, 3 pages.

European Examination Report dated Jun. 4, 2019 for EP Patent Application No. 17 195 913.3, 6 pages.

European Search Report dated Dec. 12, 2019 for EP Patent Application No. 19195452.8, 8 pages.

* cited by examiner

RETRIEVAL OF MULTI-COMPONENT PLUNGER IN WELL PLUNGER LIFT SYSTEM

BACKGROUND

This disclosure relates generally to equipment utilized and operations performed in conjunction with a subterranean well and, in an example described below, more particularly provides for retrieval of a multi-component plunger in a plunger lift system for a well.

A plunger lift system is typically used to remove an accumulation of liquid (such as, water, gas condensate, oil, mixtures thereof, etc.) from a well. In many cases where the well is for production of hydrocarbon gas, the accumulation of liquid in the well may be undesirable, in that the liquid can impede flow of the gas to surface.

Therefore, it will be appreciated that improvements are continually needed in the arts of constructing and operating plunger lift systems. Such improvements may be useful in a variety of different applications, including but not limited to displacement of liquids from production wells.

DETAILED DESCRIPTION

Figure 1A:
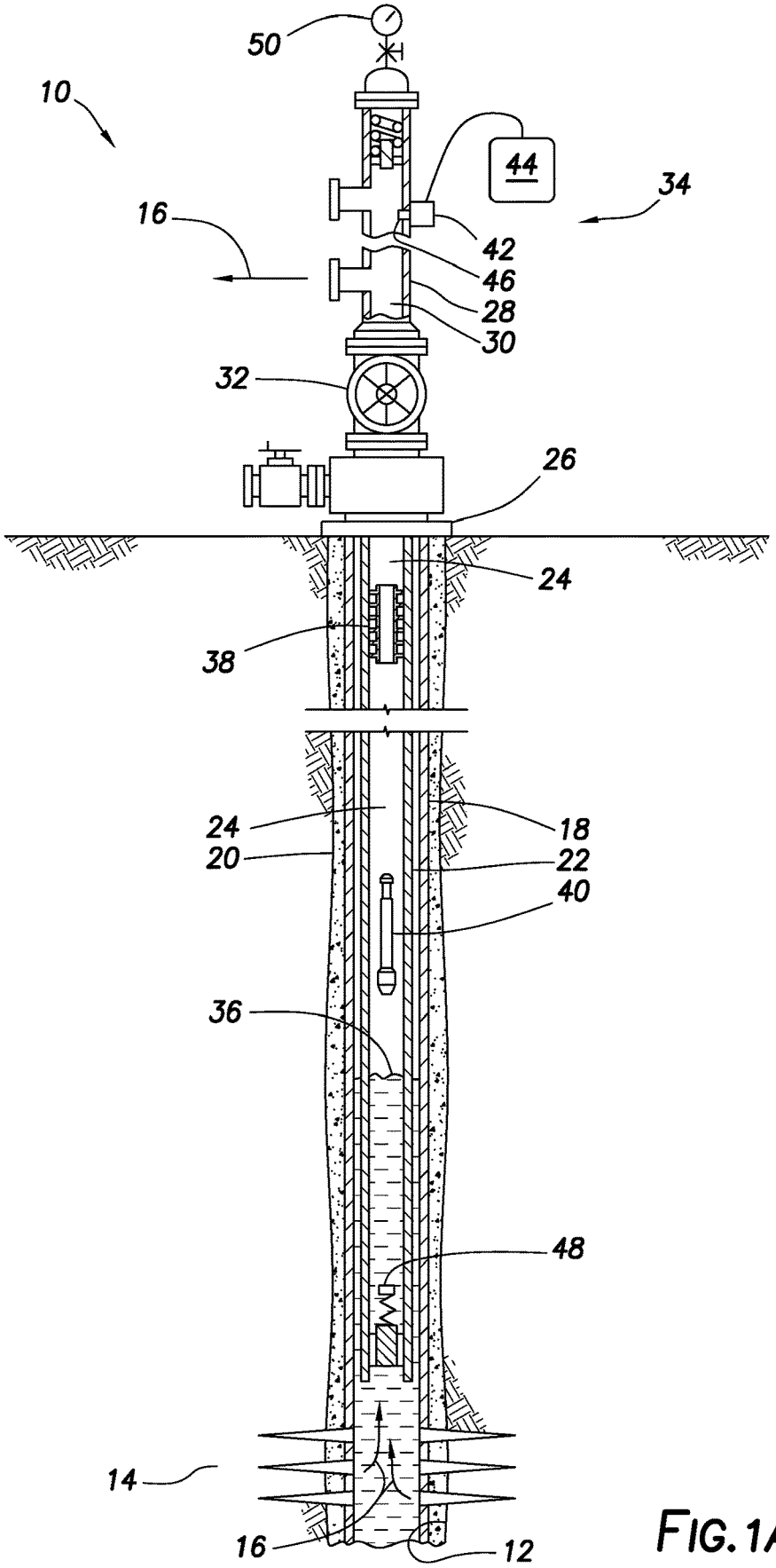
FIGS. 1A-G are representative partially cross-sectional views of an example of a well system and associated method which can embody principles of this disclosure, the views depicting a succession of steps of the method.

Representatively illustrated in FIGS. 1A-G is a well system 10 and associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIGS. 1A-G example, a wellbore 12 has been drilled into an earth formation 14 from which it is desired to produce hydrocarbon gas 16. The wellbore 12 is lined with casing 18 and cement 20.

Although the wellbore 12 is depicted in the drawings as being generally vertically oriented, in other examples the wellbore 12 could be inclined or deviated relative to vertical. In addition, it is not necessary for any particular section of the wellbore 12 to be lined with casing or cement.

Although, for clarity of illustration, only one string of the casing 18 is depicted in the drawings, it will be appreciated by those skilled in the art that multiple strings of casing are typically used. Thus, the scope of this disclosure is not limited to any numbers, combinations or configurations of various elements of the well system 10 as depicted in the drawings or described herein.

A tubular string 22 is positioned in the casing 18 for producing the gas 16 to surface via a flow passage 24 extending longitudinally through the tubular string 22. The tubular string 22 could comprise, for example, a production tubing string. The tubular string 22 could be continuous or made up of individual sections connected together. Any type of tubular string may be used in keeping with the scope of this disclosure.

The casing 18 and tubular string 22 extend to a wellhead 26 at the surface. The "surface" may be at a land-based or a water-based wellsite (e.g., the wellhead 26 could be positioned on land, on a sea floor or otherwise below water, etc.).

Connected above the wellhead 26 is a lubricator 28 having an internal flow passage 30 in communication with the flow passage 24 of the tubular string 22. Such communication between the lubricator flow passage 30 and the tubular string flow passage 24 can be permitted or prevented by selective operation of a master valve 32 connected between the lubricator 28 and the wellhead 26.

The lubricator 28, in this example, is part of a plunger lift system 34 that displaces liquid 36 from the tubular string 22. By reducing accumulation of the liquid 36 in the tubular string 22, the gas 16 can be much more readily produced from the formation 14. However, it should be clearly understood that the scope of this disclosure is not limited to any particular function, purpose, application or benefit for, or derived from, use of the plunger lift system 34.

In the FIGS. 1A-G example, the plunger lift system 34 includes a plunger sleeve 38 and a plunger closure 40. The plunger sleeve 38 and the plunger closure 40 are combinable in the well to form a unitary plunger 54 (see FIG. 1B) capable of displacing the liquid 36. Thus, the plunger sleeve 38 and the plunger closure 40 are separate components that, when combined, comprise the plunger 54, as described more fully below.

The plunger lift system 34, in this example, further includes a plunger catcher 42, and a controller 44 for controlling operation of the plunger catcher 42. When the sleeve 38 is appropriately received in the flow passage 30 of the lubricator 28, the plunger catcher 42 can be actuated to engage and secure the sleeve 38 in the lubricator 28.

For example, the plunger catcher 42 may include a key, lug, dog or other engagement member 46 extendable into engagement with the sleeve 38 in the lubricator 28. The plunger catcher 42 could include a piston, motor, solenoid, diaphragm or other type of actuator for displacing the member 46 in response to a signal received from the controller 44.

The controller 44 may be programmed to selectively release and secure the sleeve 38 for a variety of different purposes. For example, the controller 44 may be programmed to release the sleeve 38 into the tubular string 22 a certain amount of time after the closure 40 has been released into the tubular string 22, so that the sleeve 38 engages the closure 40 soon after the closure 40 has contacted a bumper spring 48 near a lower end of the flow passage 24. The amount of time may be determined based, for example, on drag characteristics of the sleeve 38 and closure 40, flow rate of the gas 16, length and inclination of the flow passage 24, etc.).

Inputs to the controller 44 could be provided manually (such as, via a keyboard, mouse, touch screen, voice recognition, data storage media, etc.), or automatically (such as, via wired or wireless transmission from various instruments or sensors 50). The controller 44 could be programmed to automatically initiate a plunger lift operation in response to certain conditions (such as, a certain reduction in pressure or flow rate as detected by one or more of the sensors 50).

Note that the sleeve 38, closure 40, plunger catcher 42 and controller 44 may be similar to those described in US publication no. 2016/0090827, which is incorporated herein in its entirety for all purposes by this reference. However, the scope of this disclosure is not limited to use of any particular configuration of the sleeve 38, closure 40, plunger catcher 42 or controller 44.

As viewed in FIG. 1A, a plunger lift operation has been initiated. The closure 40 has been introduced into the well, and is descending by force of gravity through the flow passage 24 of the tubular string 22. The sleeve 38 has also been introduced into the well, and is also descending by force of gravity through the flow passage 24 of the tubular string 22.

In one example, the sleeve 38 and closure 40 could be installed in the flow passage 30 of the lubricator 28, with the master valve 32 closed, by removing an upper portion of the lubricator 28 (such as, an upper cap or flanged connection).

The sleeve 38 could be secured in the lubricator 28 using the plunger catcher 42, and then the upper portion of the lubricator 28 could be reconnected to the lubricator.

To release the closure 40 into the flow passage 24 of the tubular string 22, the master valve 32 is opened. To release the sleeve 38 into the flow passage 24 of the tubular string 22, the plunger catcher 42 is actuated to disengage from the sleeve 38. The controller 44 can actuate the plunger catcher 42 to release the sleeve 38 a predetermined amount of time after the closure 40 is released.

Figure 1B:
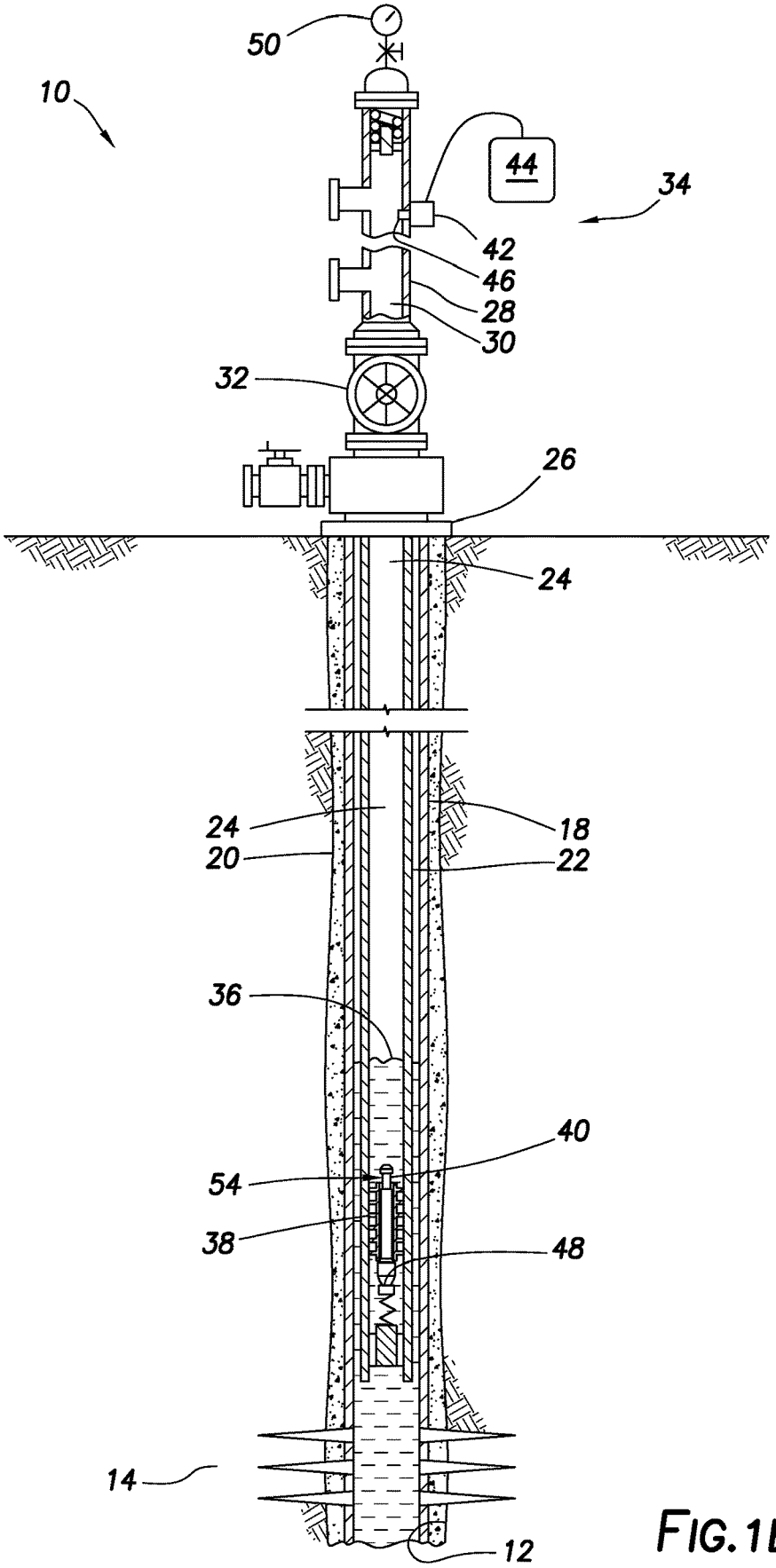

As viewed in FIG. 1B, the closure 40 has contacted the bumper spring 48, thereby preventing further descent of the closure 40 through the flow passage 24. The closure 40 is now below a level of the liquid 36 in the flow passage 24.

Figure 3:
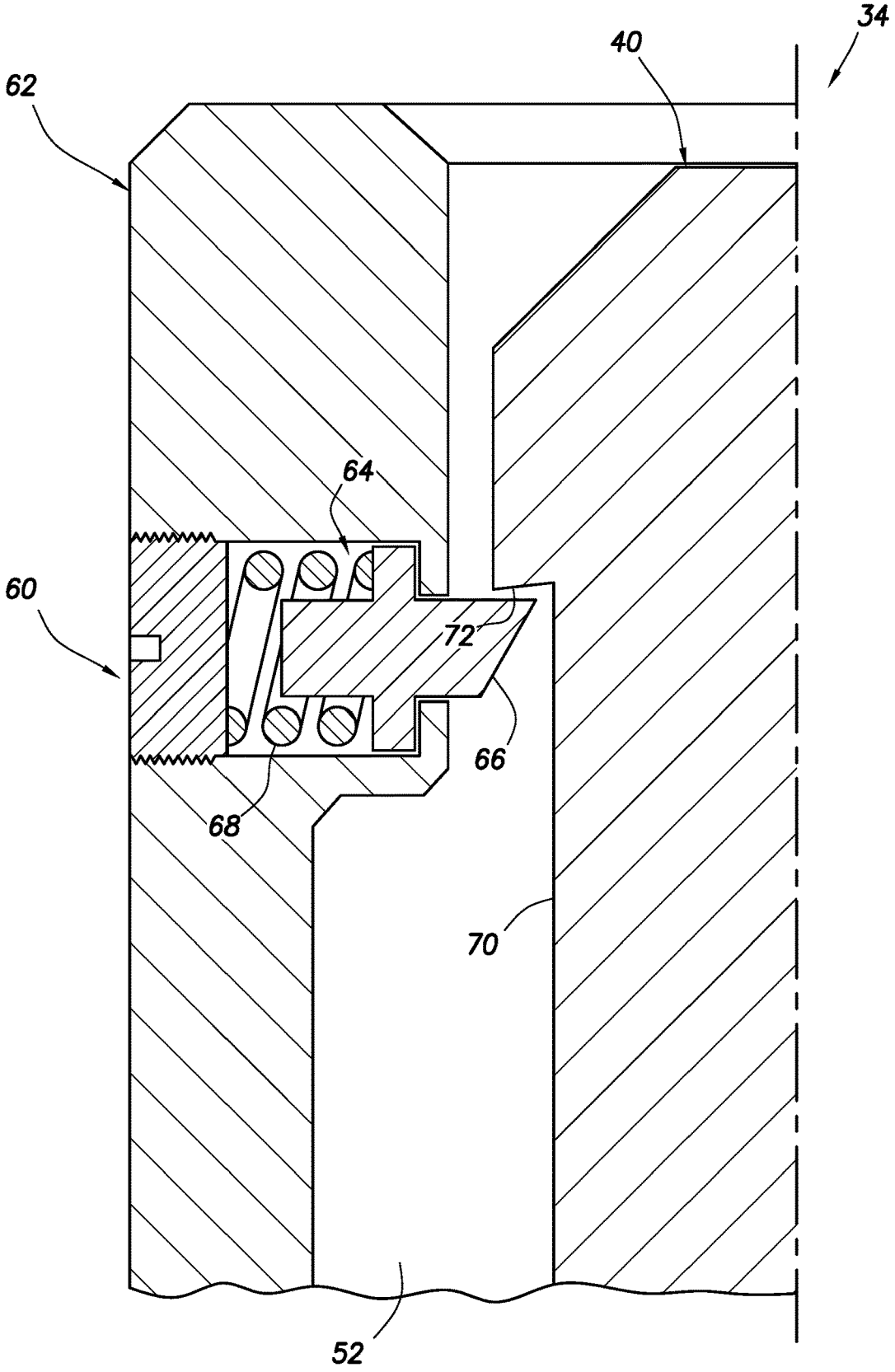
FIG. 3 is a representative cross-sectional view of a first example of the plunger retrieval device.
Figure 4:
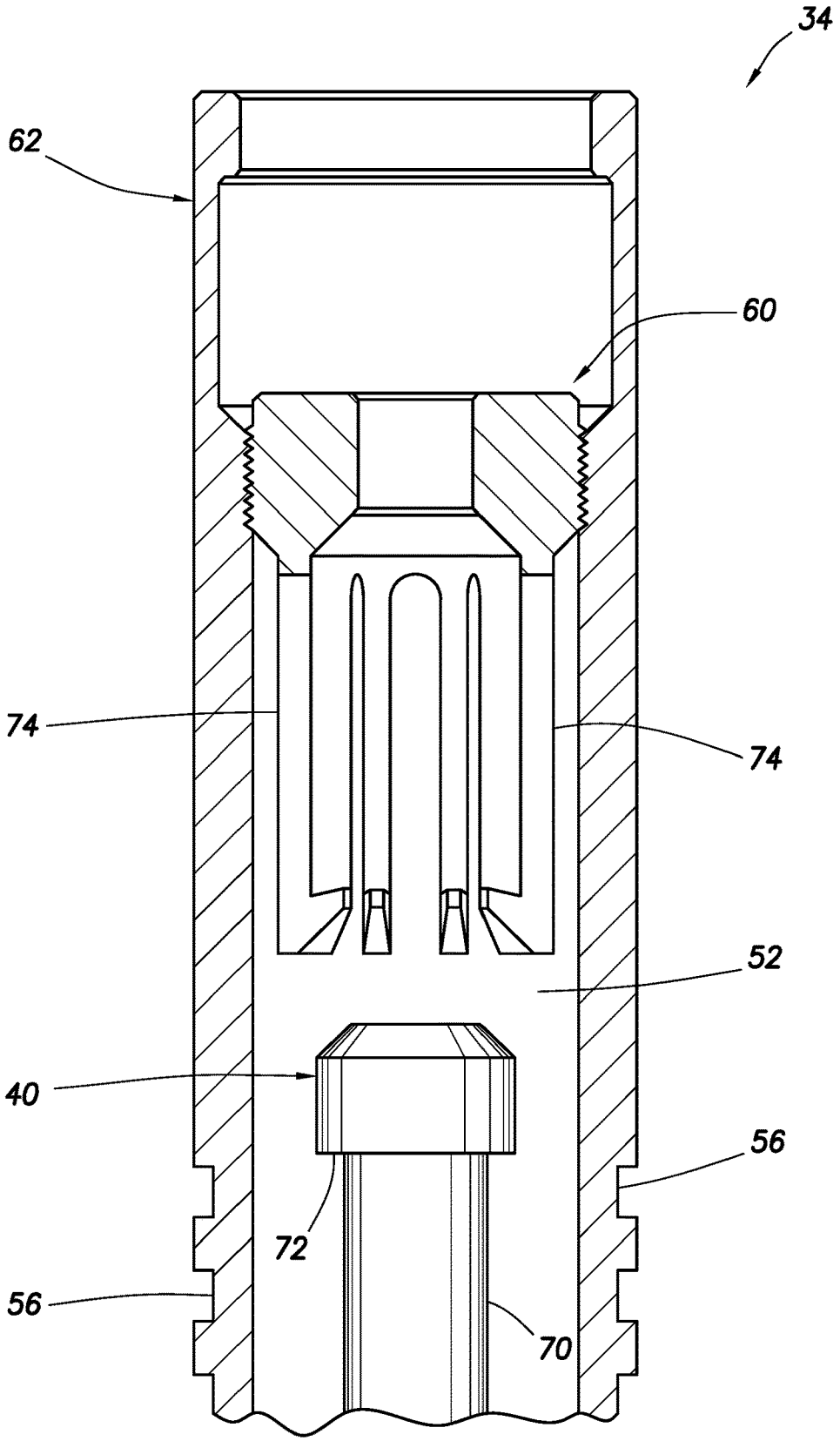
FIG. 4 is a representative cross-sectional view of a second example of the plunger retrieval device.
Figure 5:
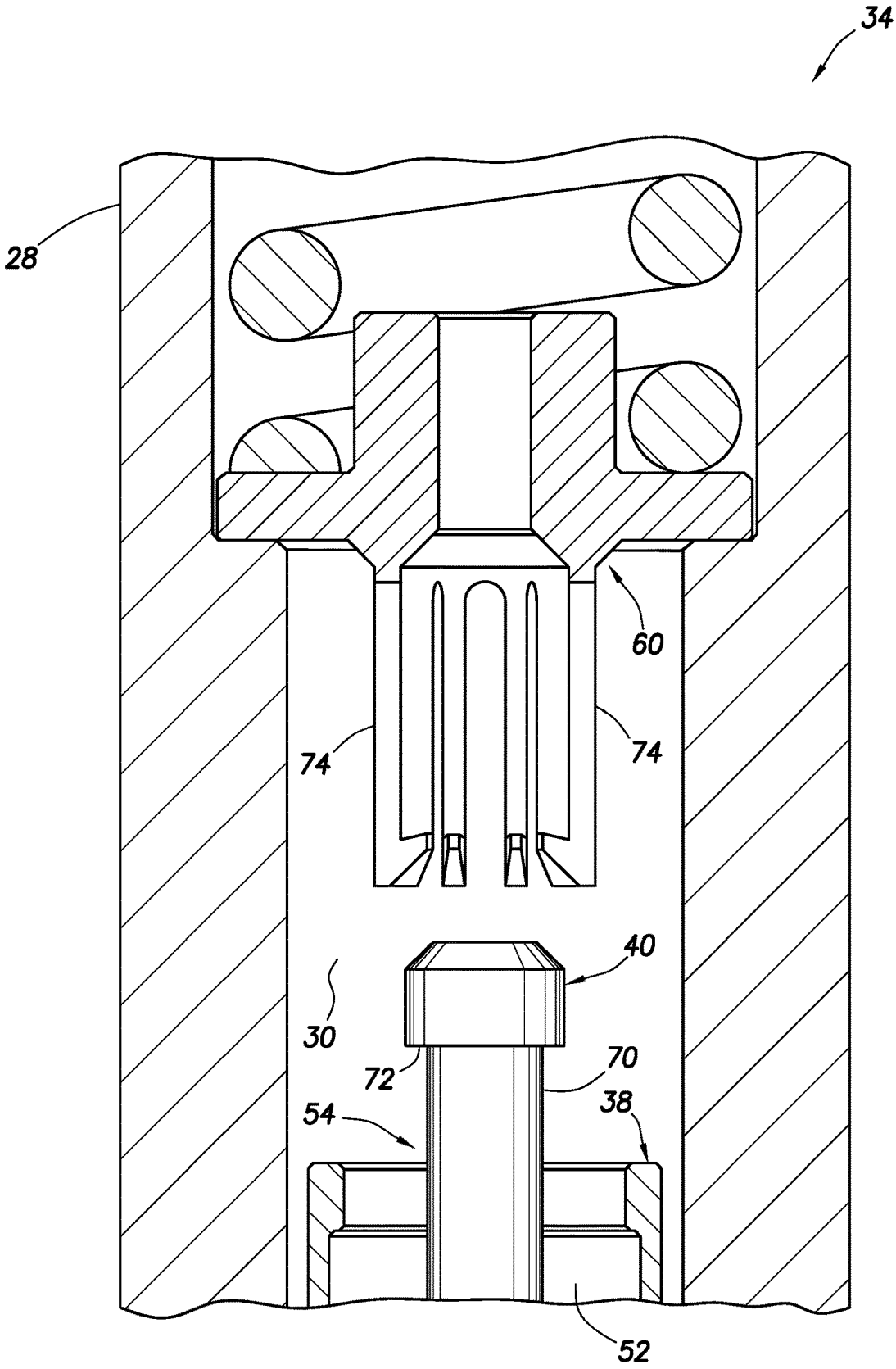
FIG. 5 is a representative cross-sectional view of a third example of the plunger retrieval device.

The sleeve 38 has also descended through the flow passage 24 to the closure 40, so that the closure 40 is received in a central longitudinal flow path 52 formed through the sleeve 38 (not visible in FIG. 1B, see FIGS. 3-5). The closure 40 blocks flow through the flow path 52, thereby allowing the plunger 54 (the combined sleeve 38 and closure 40) to displace the liquid 36 upward through the flow passage 24.

In various examples described in the US publication no. 2016/0090827 mentioned above, the plunger closure is in the form of an elongated spear having an external sealing surface formed thereon which sealingly engages an internal sealing surface formed in the plunger sleeve. The plunger closure (spear) is shaped to reduce drag as it descends through a tubing string.

As used herein, the term "closure" is used in the sense of a structure that closes off, blocks or prevents flow. In the present example, the plunger closure 40 substantially blocks or completely prevents flow through the plunger 54. A closure can have various shapes and forms, including but not limited to, a plug, spear, sleeve, dart, etc.

In some examples incorporating the principles of this disclosure, the plunger closure 40 could be in the form of a sleeve that is configured to cooperatively engage the plunger sleeve 38 to block flow through the flow path 52. In one example, the plunger closure 40 in the shape of a sleeve could receive the plunger sleeve 38 at least partially therein, to thereby close off the flow path 52, which extends through a side wall of the plunger sleeve 38. Thus, it should be clearly understood that the scope of this disclosure is not limited to any particular configuration or other details of the plunger sleeve 38 or plunger closure 40 as depicted in the drawings or described herein.

Figure 1C:
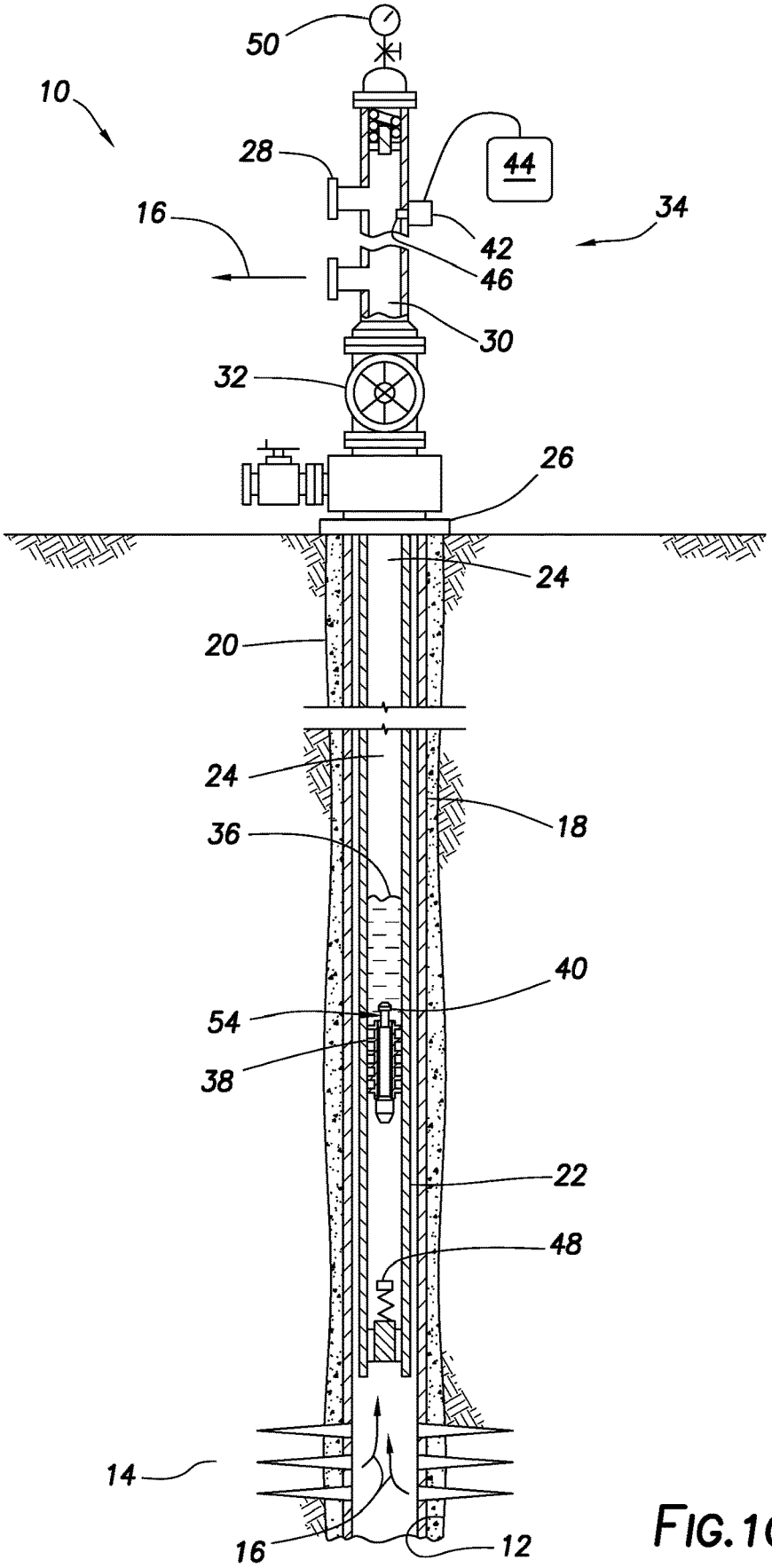

As viewed in FIG. 1C, pressure below the plunger 54 has increased, and is greater than pressure above the plunger 54 in the flow passage 24, so that the resulting pressure differential is now sufficient to displace the plunger 54 and the liquid 36 upward through the tubular string 22. The sleeve 38 in this example may not sealingly engage an interior surface of the tubular string 22, but may instead be provided with rings, grooves or other external treatment, structure or profiles 56 (see FIG. 4) to substantially restrict flow between the sleeve 38 and the interior surface of the tubular string 22, so that the pressure differential can be maintained across the plunger 54.

The plunger 54 and the liquid 36 are displaced upward through the tubular string 22 to the surface by the pressure differential across the plunger 54. The pressure differential can be maintained across the plunger 54 as it ascends through the tubular string 22, due to the closure 40 blocking fluid flow through the flow path 52 of the sleeve 38, and due to the restriction to flow between the sleeve 38 and the interior of the tubular string 22.

Figure 1D:
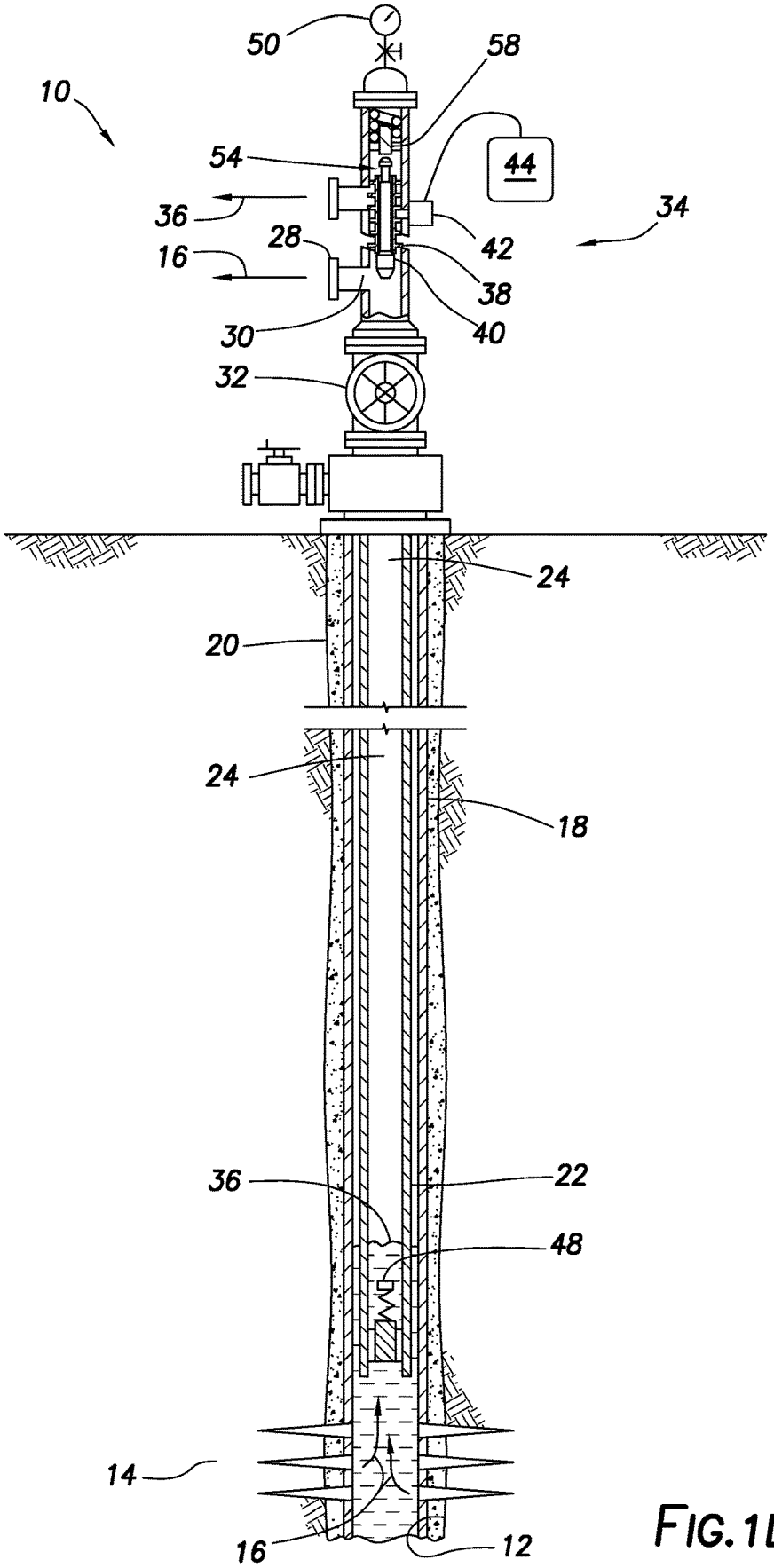

As viewed in FIG. 1D, the plunger 54 has displaced upward through the tubular string 22, and is now received in the flow passage 30 of the lubricator 28. The liquid 36 displaced by the plunger 54 is discharged from the lubricator 28 (although more liquid 36 may continually enter the casing 18 from the formation 14).

The plunger 54 continues to displace upward in the lubricator 28, until an upper end of the closure 40 contacts a strike pad 58 disposed near an upper end of the flow passage 30. This contact disengages the closure 40 from the sleeve 38, so that the pressure differential can no longer be maintained across the plunger 54, and the closure 40 is then permitted to displace downwardly away from the sleeve 38.

The sleeve 38 is secured in the lubricator 28 by the plunger catcher 42 when the plunger 54 is appropriately received in the lubricator flow passage 30. In this manner, the closure 40 can again descend through the tubular string 22, separate from the sleeve 38, after the closure 40 contacts the strike pad 58 and is thereby disengaged from the sleeve 38.

Figure 1E:
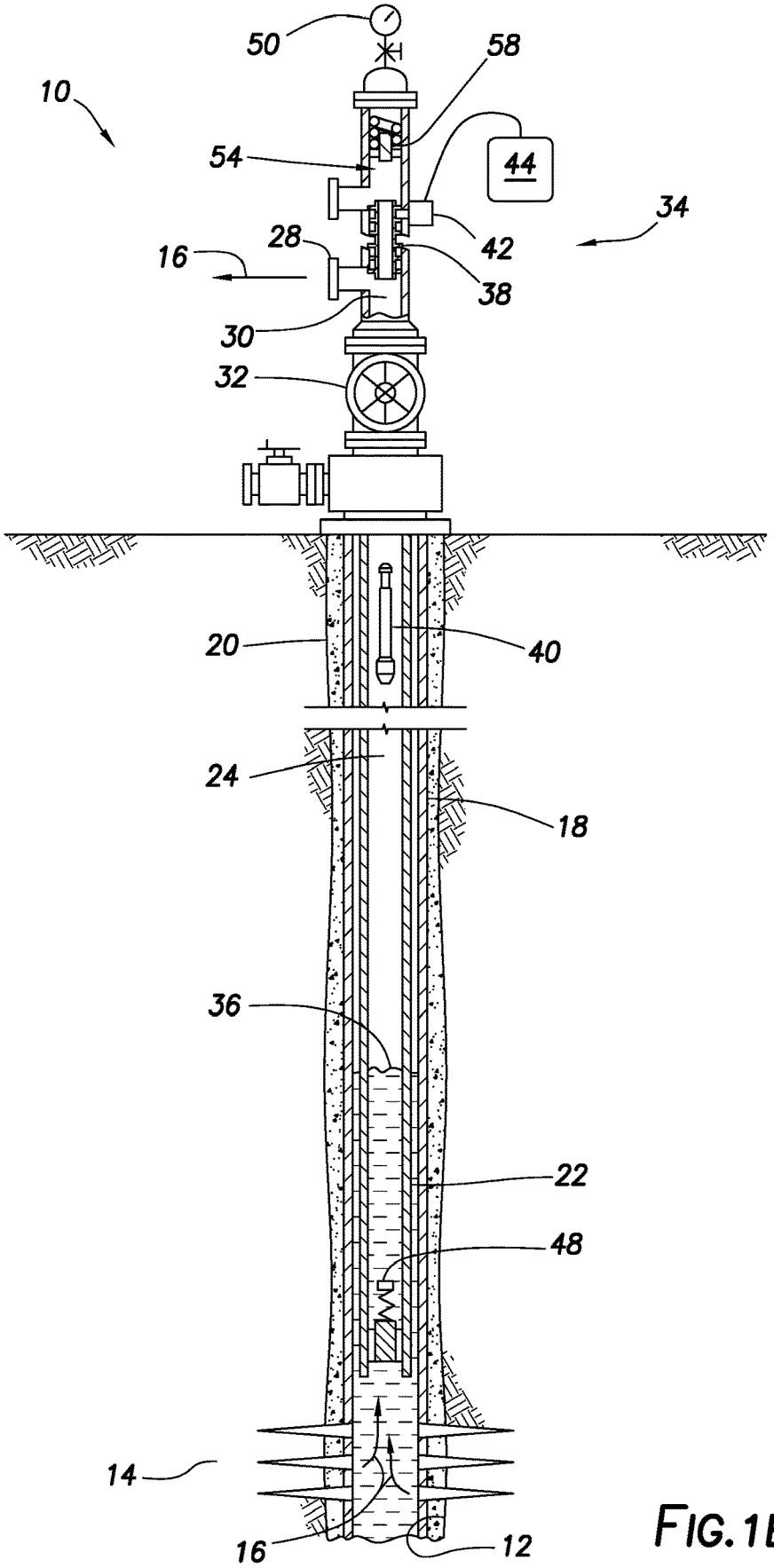

As viewed in FIG. 1E, the closure 40 is descending through the flow passage 24 of the tubular string 22, while the sleeve 38 remains secured in the lubricator 28 by the plunger catcher 42. The plunger catcher 42 can be actuated by the controller 44 to release the sleeve 38, so that it again descends through the tubular string 22, following the closure 40, as depicted in FIG. 1A.

Thus, the steps depicted in FIGS. 1A-E can be repeated to thereby repeatedly and incrementally displace the liquid 36 out of the well. Preferably, the liquid 36 can be displaced out of the well at a faster rate than the liquid 36 accumulates in the well.

When it is desired to retrieve the plunger 54 from the well (for example, due to the liquid 36 having been sufficiently removed from the well, or for maintenance or replacement of the plunger 54), a plunger retrieval device 60 (see FIG. 1F) can be utilized with the plunger lift system 34 to temporarily or permanently remove the plunger 54 from the well.

Figure 1F:
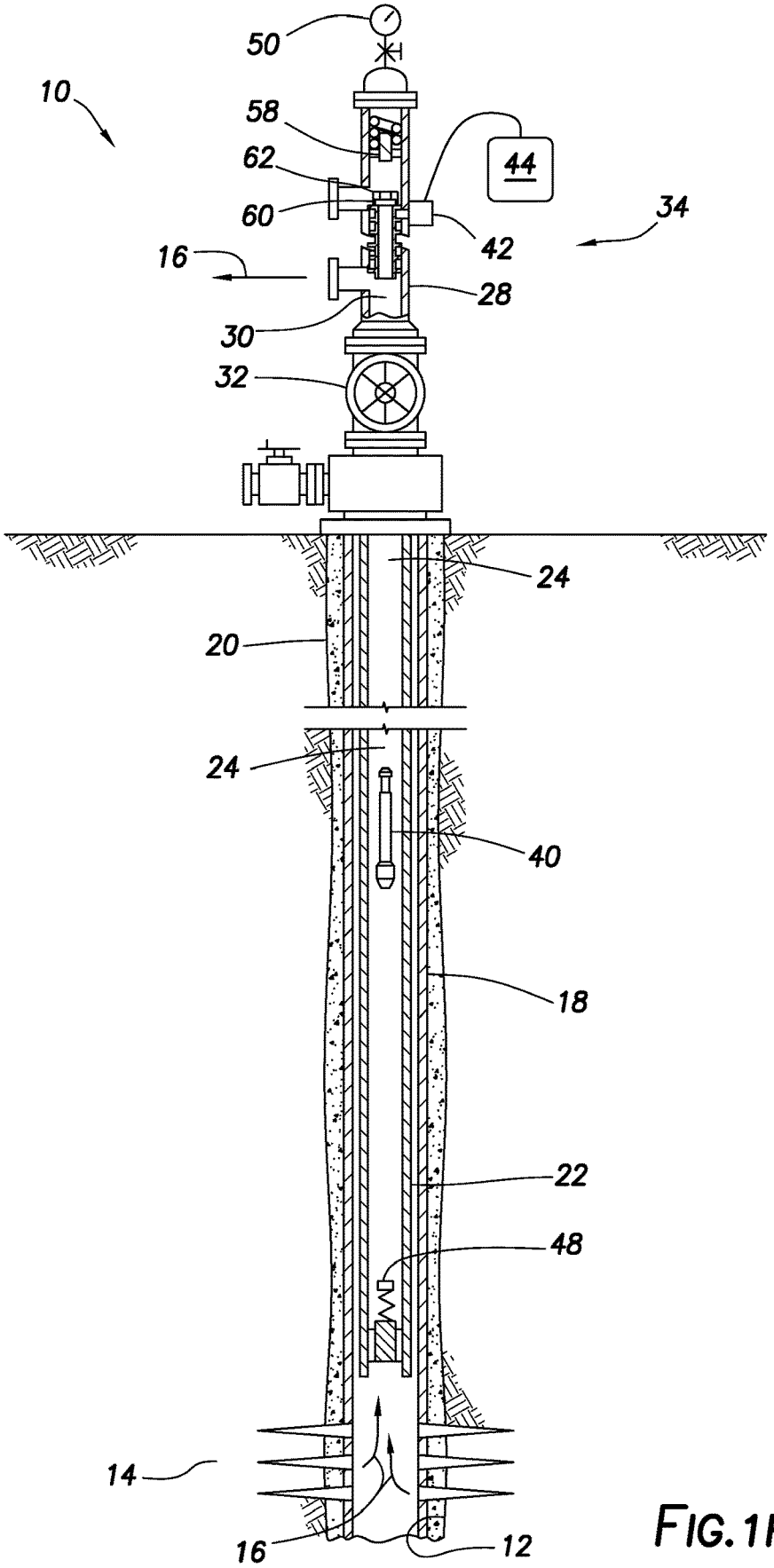

As viewed in FIG. 1F, the plunger retrieval device 60 could be connected to, or incorporated into, a plunger sleeve 62. In this example, the plunger sleeve 62 could be substituted for the plunger sleeve 38 in the lubricator 28 after the closure 40 has been disengaged from the plunger sleeve 38 due to contact between the closure 40 and the strike pad 58 (e.g., after the step of the method depicted in FIG. 1E).

The plunger sleeve 62 may be substantially the same as the plunger sleeve 38, other than the addition of the plunger retrieval device 60. In some examples, the plunger sleeve 62 could be longer than the plunger sleeve 38, so that, when the closure 40 is received in the plunger sleeve 62, the closure 40 does not extend upwardly from the plunger sleeve 62 and thus cannot contact the strike pad 58 in the lubricator 28.

Figure 1G:
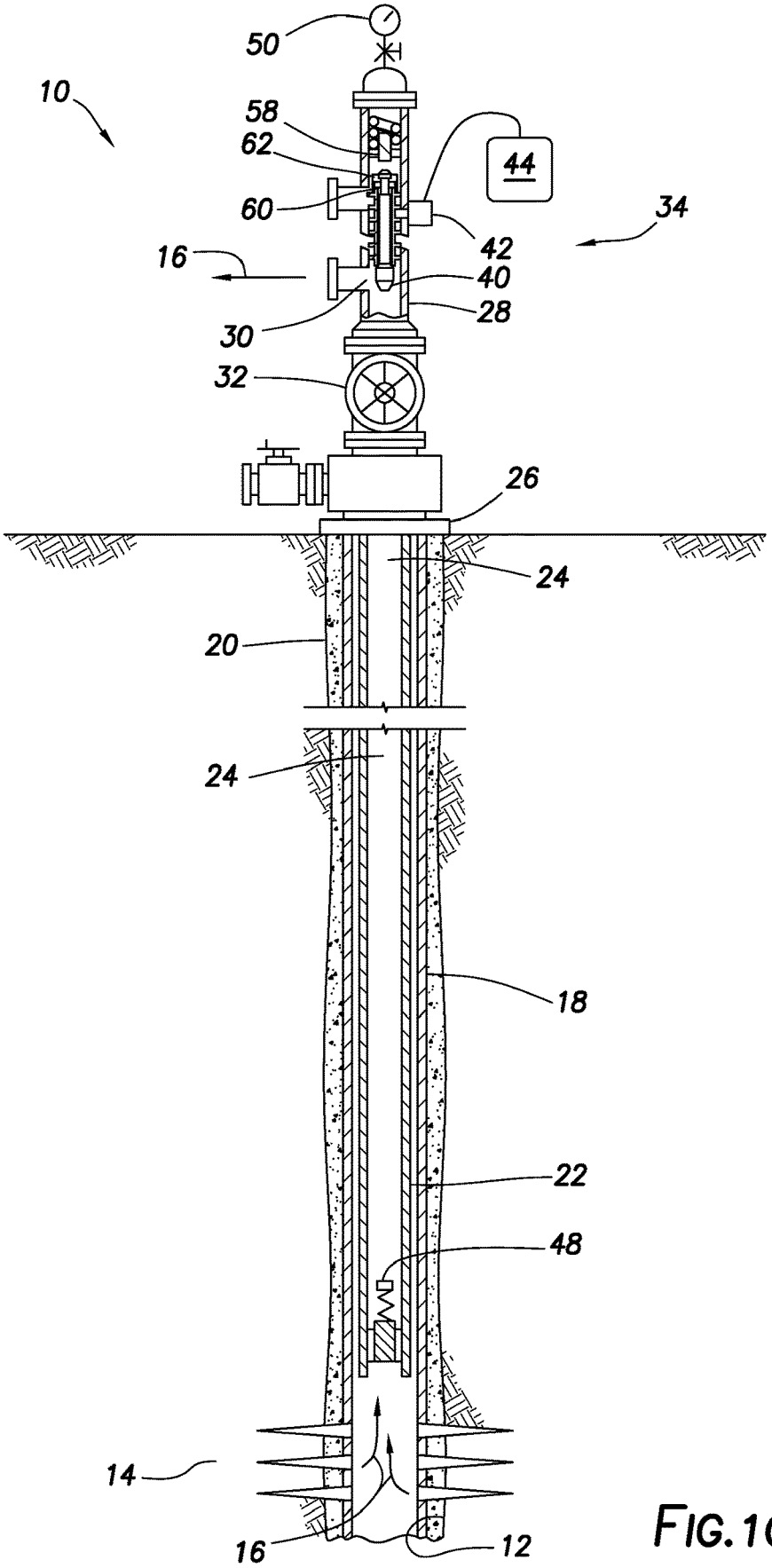

As viewed in FIG. 1G, the sleeve 62 has been engaged with the closure 40, and is now received in the flow passage 30 of the lubricator 28. The sleeve 62 can be engaged with the closure 40 in the same manner as described above for the sleeve 38 (and depicted in FIGS. 1A & B), and the combined sleeve 62 and closure 40 can be displaced upward into the lubricator flow passage 30 in the same manner as described above for the plunger 54 (and depicted in FIGS. 1C & D).

However, in the retrieval operation of FIGS. 1F & G, the plunger retrieval device 60 prevents separation of the closure 40 from the sleeve 62 after the closure 40 is engaged with the sleeve 62 in the flow passage 24 (e.g., after the closure 40 has contacted the bumper spring 48 and the sleeve 62 has received the closure 40 therein). Thus, when the closure 40 and sleeve 62 are received in the lubricator 28, the closure 40 cannot be dislodged or disengaged from the sleeve 62.

The plunger catcher 42 is actuated to secure the sleeve 62 in the lubricator 28, as viewed in FIG. 1G. Since the closure 40 cannot be dislodged or disengaged from the sleeve 62, the closure 40 and sleeve 62 can be removed together from the lubricator 28, after closing the master valve 32 and disconnecting an upper portion (such as, a top cap or flanged connection) of the lubricator 28.

Figure 2A:
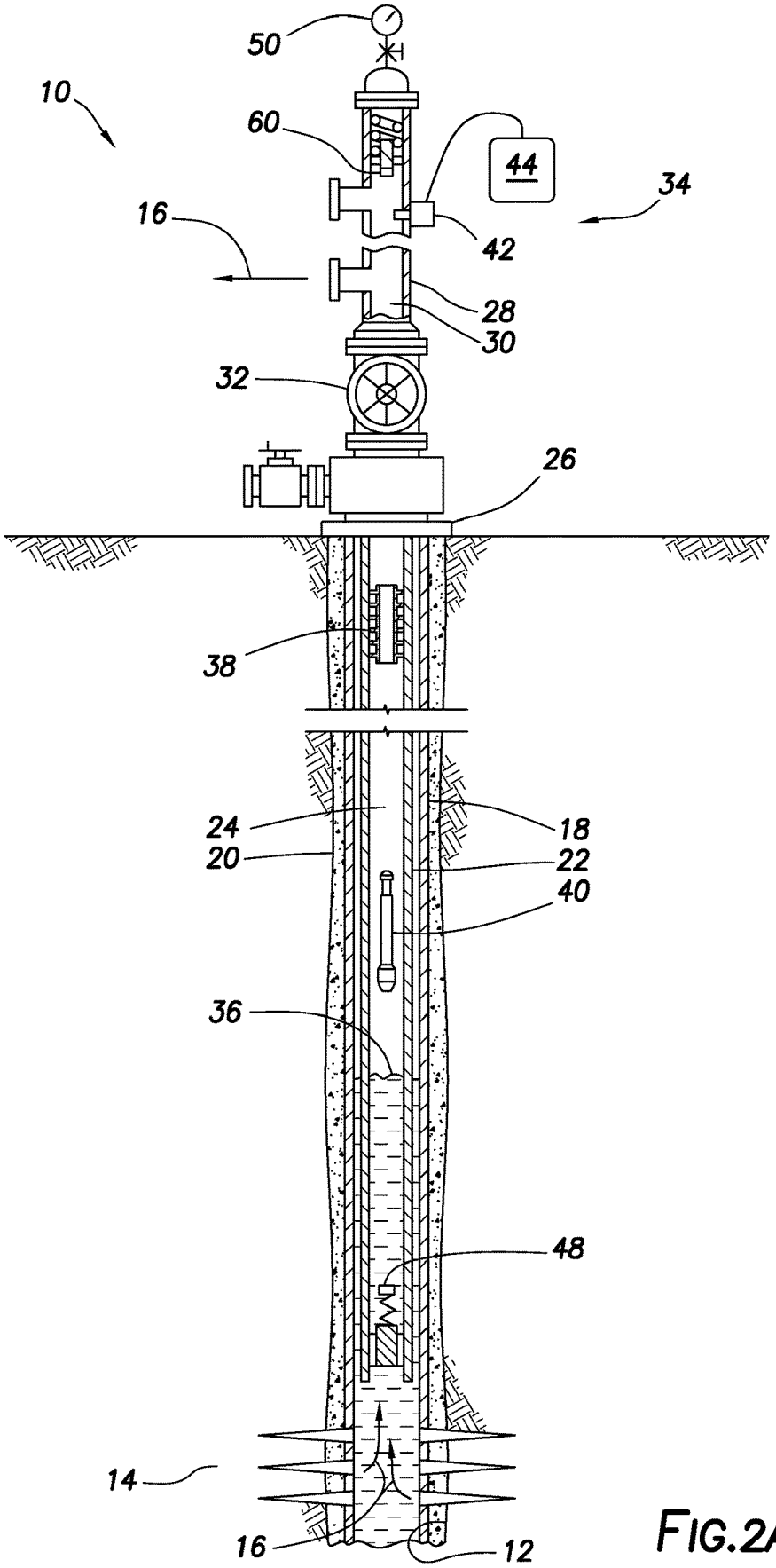
FIGS. 2A & B are representative partially cross-section views of another example of the well system and method, the views depicting a succession of steps of the method utilizing a different plunger retrieval device as compared to the example of FIGS. 1A-G.

Referring additionally now to FIGS. 2A & B, another example of the plunger lift system 34 and method is representatively illustrated. In this example, the plunger retrieval device 60 is incorporated into the lubricator 28, (instead of the plunger sleeve 62 as in the examples of FIGS. 1A-G).

The plunger lift system 34 example of FIGS. 2A & B may be operated as depicted in FIGS. 1A-E and described above, until it is desired to retrieve the plunger 54 from the well. At that time, with the plunger sleeve 38 and plunger closure 40 in the flow passage 24 of the tubular string 22, the master valve 32 can be closed, the upper portion of the lubricator 28 can be disconnected from the lubricator, and the plunger retrieval device 60 can be substituted for, or incorporated with, the strike pad 58. The upper portion of the lubricator 28 can then be reconnected to the lubricator, and the master valve 32 can be opened to resume flow of the gas 16.

Figure 2B:
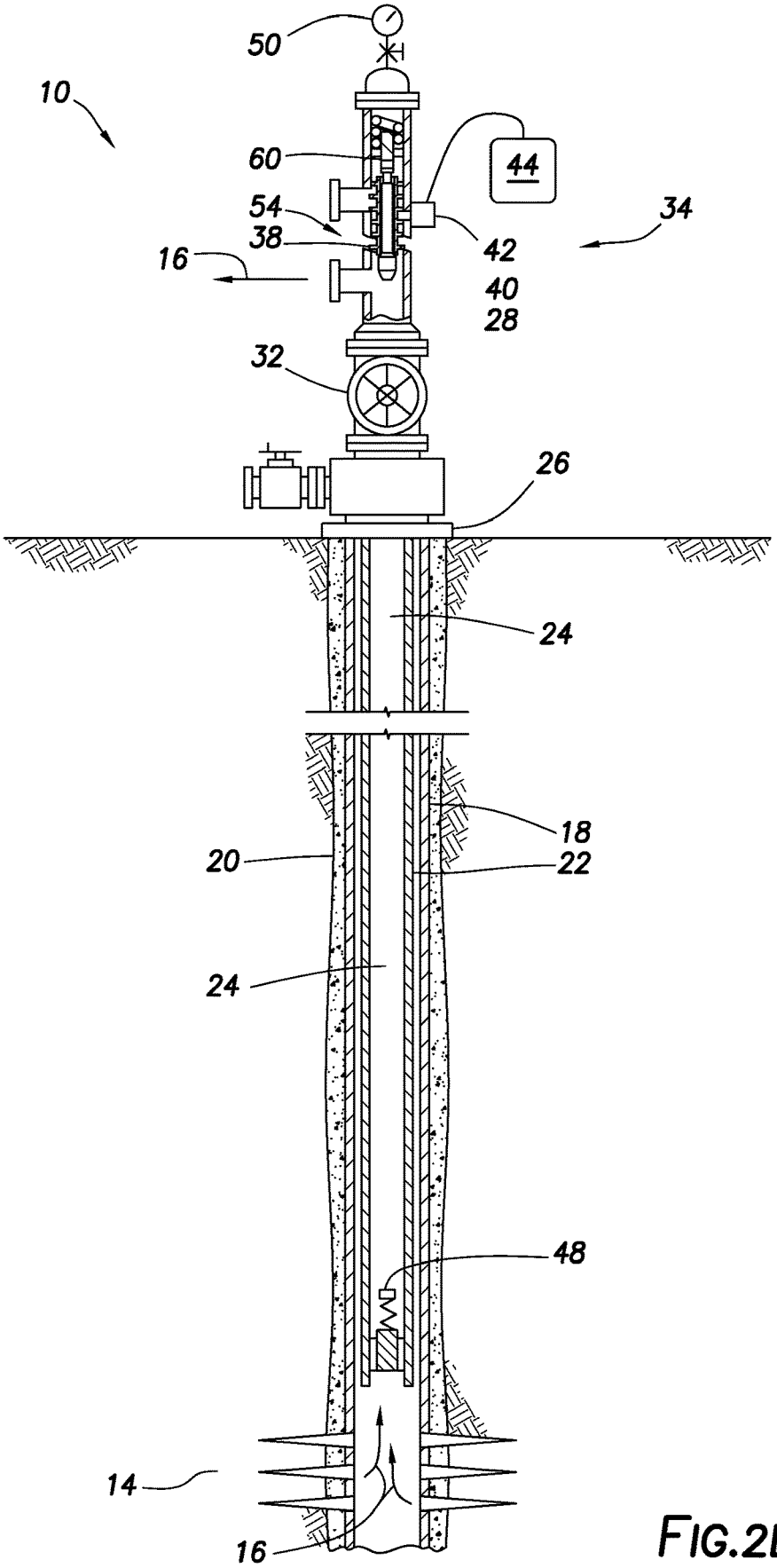

When the plunger 54 is next received in the lubricator 28 (as viewed in FIG. 2B), the plunger retrieval device 60 will engage and secure the closure 40 (such as, by latching or gripping the closure 40). Since the closure 40 is received in the sleeve 38, this will prevent both of the closure 40 and the sleeve 38 from displacing out of the lubricator 28. If provided, the optional plunger catcher 42 could also be actuated to prevent the sleeve 38 from displacing out of the lubricator 28.

The plunger 54 can now be removed by closing the master valve 32 and disconnecting the upper portion of the lubricator 28 from the lubricator. The upper portion of the lubricator 28 can be reconnected to the lubricator after removing the plunger 54 from the lubricator 28, and the master valve 32 can then be opened to resume production.

Referring additionally now to FIG. 3, an example of the plunger retrieval device 60 that may be used in the plunger lift system 34 of FIGS. 1A-G is representatively illustrated. However, the plunger retrieval device 60 of FIG. 3 may be used with other plunger lift systems, in keeping with the principles of this disclosure.

In the FIG. 3 example, the plunger retrieval device 60 comprises a latch 64 that engages and secures the plunger closure 40 in response to the closure 40 being received in the flow path 52. The latch 64 depicted in FIG. 3 includes a latch member 66 biased radially inward relative to the flow path 52 by a spring 68 or other type of biasing device. Any number of plunger retrieval devices 60 may be used with the sleeve 62

When the closure 40 is received sufficiently into the flow path 52, the latch member 66 is initially urged radially outward by the closure 40, and then the latch member 66 is resiliently biased radially inward by the spring 68. The latch member 66, thus, is received in a radially reduced profile 70 formed near an upper end of the closure 40 (for example, of the type known to those skilled in the art as a "fishing neck" profile). A shoulder 72 formed at an upper end of the profile 70 will engage the latch member 66 to prevent separation of the closure 40 from the sleeve 62.

Note that the sleeve 62 extends upwardly further than the closure 40. This can, in some examples, prevent the closure 40 from contacting the strike pad 58 in the lubricator 28 (see FIG. 1D), so that the closure 40 is not inadvertently dislodged from the sleeve 62 by such contact. Thus, the closure 40 and sleeve 62 are secured together for retrieval from the well.

Referring additionally now to FIG. 4, another example of the plunger retrieval device 60 that may be used in the plunger lift system 34 of FIGS. 1A-G is representatively illustrated. The plunger retrieval device 60 of FIG. 4 may be used with other plunger lift systems, in keeping with the principles of this disclosure.

In the FIG. 4 example, the plunger retrieval device 60 includes multiple resilient collets 74 disposed in the flow path 52. When the closure 40 is received sufficiently far into the flow path 52, the collets 74 will be initially urged radially outward by the closure 40, and then the collets 74 will be resiliently biased radially inward and received in the profile 70. The shoulder 72 will engage the collets 74 to prevent separation of the closure 40 from the sleeve 62.

Referring additionally now to FIG. 5, another example of the plunger retrieval device 60 is representatively illustrated for use with the plunger lift system 34 of FIGS. 2A & B, in which the plunger retrieval device 60 is incorporated into the lubricator 28. The plunger retrieval device 60 of FIG. 5 may be used with other plunger lift systems, in keeping with the principles of this disclosure.

In the FIG. 5 example, the plunger retrieval device 60 is substituted for the strike pad 58 in the lubricator 28. The FIG. 5 plunger retrieval device 60 includes the collets 74, similar to those of the plunger retrieval device 60 of FIG. 4.

When the plunger 54 is received sufficiently far into the lubricator flow passage 30, the collets 74 will be initially urged radially outward by the closure 40, and then the collets 74 will be resiliently biased radially inward and received in the profile 70. The shoulder 72 will engage the collets 74 to prevent separation of the closure 40 from the plunger retrieval device 60, and thereby secure the plunger 54 in the lubricator 28.

It may now be fully appreciated that the above disclosure provides significant advancements to the arts of constructing and operating plunger lift systems. In examples described above, the plunger 54 can be conveniently and reliably retrieved from a well, either as a unit (e.g., the combined sleeve 38 and closure 40) or by separate components (e.g., the sleeve 38 first, and then the combined closure 40 and sleeve 62).

The above disclosure provides to the art a method of operating a plunger lift system 34 for a subterranean well. In one example, the method comprises: introducing a plunger sleeve 38 or 62 and a plunger closure 40 into the well; engaging the plunger sleeve 38/62 with the plunger closure 40; securing the plunger sleeve 38/62 and the plunger closure 40 to each other in a flow passage 24 or 30 of the well; and then retrieving the plunger sleeve 38/62 and the plunger closure 40 from the well.

The securing step may include a plunger retrieval device 60 preventing displacement of the plunger sleeve 38/62 and the plunger closure 40 away from each other.

The introducing step may include introducing the plunger retrieval device 60 with the plunger sleeve 62 into the well.

The securing step may include the plunger retrieval device 60 confining the plunger closure 40 to displace with the plunger sleeve 62 in the well. The securing step may be performed in response to the engaging step.

The securing step may comprise disposing a plunger retrieval device 60 in a lubricator 28. The securing step may also comprise the plunger retrieval device 60 engaging the plunger closure 40 in the lubricator 28 and preventing displacement of the plunger closure 40 and the plunger sleeve 38 out of the lubricator 28.

The retrieving step may comprise retrieving the plunger sleeve 38/62 and plunger closure 40 while the plunger sleeve 38/62 and the plunger closure 40 are secured to each other.

Also provided to the art by the above disclosure is a plunger lift system 34 for use with a subterranean well. In one example, the plunger lift system 34 can include a plunger sleeve 62 configured for reciprocal displacement in a flow passage 24 of the well, a plunger closure 40 configured to block flow through a flow path 52 of the plunger sleeve 62, the plunger closure 40 being displaceable in the flow passage 24 separate from the plunger sleeve 62, and a plunger retrieval device 60 that displaces with the plunger sleeve 62 in the flow passage 24 and secures the plunger closure 40 against displacement away from the plunger sleeve 62.

The plunger retrieval device 60 may secure the plunger closure 40 against displacement away from the plunger sleeve 62 in response to engagement between the plunger closure 40 and the plunger sleeve 62 in the flow passage 24, or in response to the plunger closure 40 being received in the flow path 52 of the plunger sleeve 62.

The plunger retrieval device 60 may comprise a latch 64 connected with the plunger sleeve 62. The latch 64 may engage the plunger closure 40 in response to the plunger closure 40 being received in the flow path 52 of the plunger sleeve 62.

The plunger retrieval device 60 may comprise resilient collets 74 connected with the plunger sleeve 62. The collets 74 may engage the plunger closure 40 in response to the plunger closure 40 being received in the flow path 52 of the plunger sleeve 62.

Another plunger lift system 34 for use with a subterranean well is described above. In this example, the plunger lift system 34 includes a plunger sleeve 38 configured for reciprocal displacement in a flow passage 24 of the well, a plunger closure 40 configured to block flow through a flow path 52 of the plunger sleeve 38, the plunger closure 40 being displaceable in the flow passage 24 separate from the plunger sleeve 38, and a plunger retrieval device 60 positioned in a lubricator 28. The plunger retrieval device 60 engages the plunger closure 40 and secures the plunger closure 40 against displacement away from the plunger sleeve 38 in the lubricator 28.

The plunger retrieval device 60 may secure the plunger closure 40 against displacement away from the plunger sleeve 38 in response to engagement between the plunger closure 40 and the plunger retrieval device 60 in the lubricator 28, or in response to the plunger closure 40 and the plunger sleeve 38 being received in the lubricator 28.

The plunger retrieval device 60 may comprise resilient collets 74 disposed in a flow passage 30 of the lubricator 28. The collets 74 may engage the plunger closure 40 in response to the plunger closure 40 and the plunger sleeve 38 being received in the lubricator 28.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method of operating a plunger lift system for a subterranean well, the method comprising:

introducing a first plunger sleeve and a plunger closure into the well;

engaging the first plunger sleeve with the plunger closure;

securing a second plunger sleeve and the plunger closure to each other in a flow passage of the well, wherein the securing prevents the plunger closure from separating from the second plunger sleeve in the well;

then displacing the second plunger sleeve and the plunger closure to an upper portion of the flow passage via a pressure differential across the second plunger sleeve and the plunger closure; and then retrieving the second plunger sleeve and the plunger closure from the upper portion of the flow passage.

2. The method of claim 1, wherein the securing comprises a plunger retrieval device preventing displacement of the second plunger sleeve and the plunger closure away from each other.

3. The method of claim 2, wherein the introducing comprises introducing the plunger retrieval device with the second plunger sleeve into the well.

4. The method of claim 3, wherein the securing further comprises the plunger retrieval device confining the plunger closure to displace with the second plunger sleeve in the well.

5. The method of claim 4, wherein the securing is performed in response to engaging the second plunger sleeve with the plunger closure.

6. The method of claim 1, further comprising preventing displacement of the plunger closure and the second plunger sleeve out of a lubricator.

7. The method of claim 1, wherein the retrieving comprises retrieving the second plunger sleeve and plunger closure while the second plunger sleeve and the plunger closure are secured to each other.

8. A plunger lift system for use with a subterranean well, the plunger lift system comprising:

a plunger sleeve configured for reciprocal displacement in a flow passage of the well, wherein the plunger sleeve comprises a plunger retrieval device;

a plunger closure configured to block flow through a flow path of the plunger sleeve, the plunger closure being displaceable in the flow passage separate from the plunger sleeve and the plunger retrieval device; and wherein the plunger retrieval device secures the plunger closure against displacement away from the plunger sleeve when the plunger sleeve reaches an upper extent of travel in the flow passage due to a pressure differential across the plunger sleeve and the plunger closure.

9. The plunger lift system of claim 8, wherein the plunger retrieval device secures the plunger closure against displacement away from the plunger sleeve in response to engagement between the plunger closure and the plunger sleeve in the flow passage.

10. The plunger lift system of claim 8, wherein the plunger retrieval device secures the plunger closure against displacement away from the plunger sleeve in response to the plunger closure being received in the flow path of the plunger sleeve.

11. The plunger lift system of claim 8, wherein the plunger retrieval device comprises a latch connected with the plunger sleeve.

12. The plunger lift system of claim 11, wherein the latch engages the plunger closure in response to the plunger closure being received in the flow path of the plunger sleeve.

13. The plunger lift system of claim 8, wherein the plunger retrieval device comprises resilient collets connected with the plunger sleeve.

14. The plunger lift system of claim 13, wherein the collets engage the plunger closure in response to the plunger closure being received in the flow path of the plunger sleeve.

15. A plunger lift system for use with a subterranean well, the plunger lift system comprising:

a plunger sleeve configured for reciprocal displacement in a flow passage of the well;

a plunger closure configured to block flow through a flow path of the plunger sleeve, the plunger closure being displaceable in the flow passage separate from the plunger sleeve; and a plunger retrieval device positioned in a lubricator, wherein the plunger retrieval device retains both the plunger closure and the plunger sleeve in the lubricator when the plunger sleeve and the plunger closure are displaced into the lubricator by a pressure differential across the plunger sleeve and the plunger closure, and wherein the plunger closure and the plunger sleeve displace into the lubricator while the lubricator does not include the plunger retrieval device, and the plunger closure and the plunger sleeve displace into the lubricator while the lubricator does include the plunger retrieval device.

16. The plunger lift system of claim 15, wherein the plunger retrieval device secures the plunger closure against displacement away from the plunger sleeve in response to engagement between the plunger closure and the plunger retrieval device in the lubricator.

17. The plunger lift system of claim 15, wherein the plunger retrieval device secures the plunger closure against displacement away from the plunger sleeve in response to the plunger closure and the plunger sleeve being received in the lubricator.

18. The plunger lift system of claim 15, wherein collets engage the plunger closure in response to the plunger closure and the plunger sleeve being received in the lubricator.

* * * * *